US005500653A

United States Patent [19]

Kamihata

[11] Patent Number: 5,500,653

[45] Date of Patent: Mar. 19, 1996

[54] CHARACTER DATA WRITING DEVICE

[75] Inventor: Toshio Kamihata, Nagoya, Japan

[73] Assignee: Kabushiki Kaisha Toshiba, Kawasaki, Japan

[21] Appl. No.: 313,896

[22] Filed: Sep. 28, 1994

[30] Foreign Application Priority Data

Sep. 29, 1993 [JP] Japan ..... 5-242559

[51] Int. Cl.[6] ..... G09G 3/36

[52] U.S. Cl. ..... 345/98; 345/141

[58] Field of Search ..... 345/98, 94, 99, 345/100, 141

[56] References Cited

U.S. PATENT DOCUMENTS 4,859,998 8/1989 Kawamura et al. ..... 345/98

5,051,739 9/1991 Hayashida et al. ..... 345/98

*Primary Examiner*—Tommy P. Chin

*Assistant Examiner*—Gin Goon

*Attorney, Agent, or Firm*—Oblon, Spivak, McClelland, Maier, & Neustadt

[57] ABSTRACT

A display data holding circuit holds character data, and serially outputs character data. A display data switching circuit inputs character data outputted from the display data holding circuit to a display data holding circuit again, and the display data switching circuit receives a switching command of display data, thereby switching character data outputted from the display data holding circuit to new character data to be inputted to the display data holding circuit. A display data latching circuit synchronizes character data outputted from the display data holding circuit with the latch pulse to be latched. A latch pulse generating circuit generates a latch pulse. A modulo N counter counts a number of clock pulses outputted from the latch pulse, and generates a reset pulse every time when the count of N number of clock pulses is ended, and the modulo N counter receives a forced reset signal, thereby generating a reset pulse. A control section supplies the switch command of display data to the display data switching circuit, and the forced reset signal to the modulo N counter at the same time.

2 Claims, 3 Drawing Sheets

CHARACTER DATA WRITING DEVICE

BACKGROUND OF THE INVENTION

1. Field of the Invention

The present invention relates to a character data writing device and more particularly to a character data writing device used in a calculator.

2. Description of the Related Art

A calculator of liquid crystal display type comprises a CPU (central processing unit), a ROM (read only memory) for storing a program, a key input section, a liquid crystal display section, and a character data writing device.

FIG. 1 shows a conventional character data writing device.

Since this character data writing device is relatively simply structured, the device can be manufactured at a low cost.

Reference numeral 40 is a ROM for storing character data. Reference numeral 41 is a display data switching circuit for selecting character data from the ROM 40 or data from a shift register (display data holding circuit) 42 based on a display data switching command.

A CPU generates a switching command of display data based on the input of the key, which is used in a replacement processing or a calculation processing.

The shift register 42 holds data, which is serially outputted from display data switching circuit 41, and supplies data to display data switching circuit 41.

The shift register 42 supplies data, which is serially outputted from display data switching circuit 41, to display data switching circuit 41, and holds data. The holding operation of display data is continued as long as a switch command of new display data is not generated.

A latch pulse generating circuit 44 supplies a latch pulse to a latch circuit 45 of display data. The latch pulse is outputted every time when a count of a clock pulse, which is inputted to a modulo N counter 43 from the latch pulse generating circuit 44, is ended.

Display data, which is outputted from the shift register 42, is inputted to the latch circuit 45. Display data is synchronized with the latch pulse, and latched by the latch circuit 45. Latched data (for example, bit data of 7 segments) is supplied to each digit place of a crystal display as a segment signal.

In the above-structured character data writing device, timing (writing timing of character data), which is used to latch display data, which is outputted from the shift register 42, to the latch circuit 45, is determined by the latch pulse.

Therefore, the writing of display data is set to be in a standby state by a software processing until the switching command of display data is generated and display data and the latch pulse are synchronized with each other.

Due to this, as shown in FIG. 2, a step of a write waiting command is needed in a part of a routine of the program of the CPU.

However, if the writing of display data is set to be in a standby state by a software processing in displaying character data, there is a disadvantage in that a writing speed of character data becomes low.

On the other hand, it can be considered that a clock frequency is increased so as to make the writing speed of character data higher.

However, many batteries are often used as a power source in the calculator. Therefore, in the calculator, a consumption electrical current, which is as low as possible, is needed in the calculator. In other words, in the calculator, which is presently used, there is a disadvantage in that the clock frequency can not be unnecessarily increased.

SUMMARY OF THE INVENTION

The present invention has been made to solve the above-mentioned disadvantage, and an object of the present invention is to write character data immediately when a data switching command is generated, thereby improving a writing speed of character data without increasing a clock frequency.

In order to attain the above object, there is provided a character data writing device comprising a latch pulse generating section for generating a latch pulse; a character data writing section for receiving the latch pulse after receiving a switching command of display data, thereby latching character data and supplying character data to a character data display section; and a control section for supplying the switching command of display data to character data display section and a forced reset signal is supplied to the latch pulse generating section at the same time, whereby a latch pulse is immediately generated.

Moreover, character data writing section comprises: a display data holding circuit for holding character data, and serially outputting character data; a display data switching circuit for inputting character data outputted from display data holding circuit to display data holding circuit again, and display data switching circuit for receiving the switching command of display data, thereby switching character data outputted from the display data holding circuit to a new character data to be inputted to display data holding circuit; and a display data latching circuit for synchronizing character data outputted from display data holding circuit with the latch pulse to be latched; and the latch pulse generating section comprises a latch pulse generating circuit for generating a latch pulse; and a modulo N counter for counting a number of clock pulses outputted from the latch pulse and for generating a reset pulse every time when the count of N number of clock pulses is ended, and the modulo N counter for receiving a forced reset signal, thereby generating a reset pulse; and the control circuit supplies the switch command of display data to display data switching section, and the forced reset signal to the modulo N counter at the same time.

Furthermore, display data holding circuit comprises a plurality of shift registers cascade-connected, character data outputted from display data switching circuit is inputted to a first shift register, character data outputted from the first shift register is inputted to display data latch circuit and a last shift register, and character data outputted from the last shift register is inputted to display data switching circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

The following will explain a character data writing device of the present invention in detail with reference to the drawings.

Figure 3:
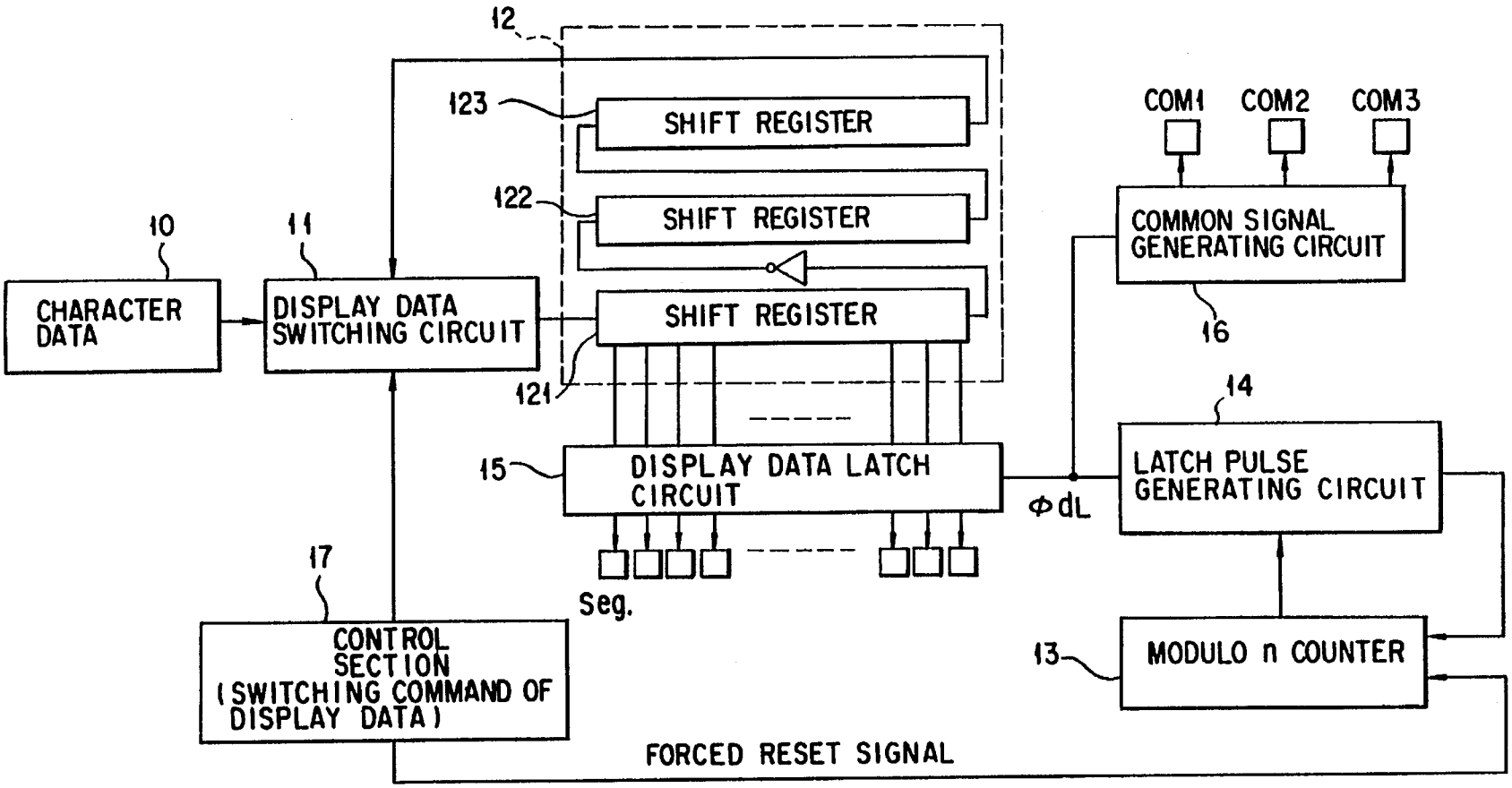
FIG. 3 is a block diagram showing a character display data writing device of the present invention.

FIG. 3 shows a character data writing device of the present invention.

The character data writing device uses a driving system of ⅓ duty and ½ pre-bias. For example, this is used in a liquid crystal calculator having a plurality of digit places.

Reference numeral 10 is a ROM for storing character data. Reference numeral 11 is a display data switching circuit for selecting character data from the ROM 10 or data from a display holding circuit 12 based on a switching command of display data.

A control section (CPU) 17 generates a switching command of display data based on the input of the key, which is used in a replacement processing or a calculation processing.

The display data holding circuit 12 comprises three shift registers cascade-connected. Each shift register corresponds to drive duty ratio of display data of the liquid crystal display.

A shift register 121 holds character data serially inputted from the display data switching circuit 11. Also, data, which is serially outputted from a shift register 123, is inputted to the display data switching circuit 11.

When the display data switching circuit 11 selects output data of the shift register 123, output data of the shift register 123 is inputted to the shift register 121. Due to this, the display data holding circuit 12 holds output data of the shift register 123 as display data. The holding operation of display data is continued as long as a switch command of new display data is not generated.

Reference numeral 13 is a modulo N counter for counting a number of clock pulses and for generating a reset pulse every time when the count of N number of clock pulses is ended.

A latch pulse generating circuit 14 supplies a clock pulse to the modulo N counter. Also, the latch pulse generating circuit 14 synchronizes with the reset pulse of the modulo N counter 13, and supplies a latch pulse ϕdL to a display data latch circuit 15. The latch pulse generating circuit 14 also supplies the latch pulse ϕdL to a common signal (COM1 to COM3) generating circuit 16 for liquid crystal display drive as a switching timing signal.

Display data of the shift register 121 of the display data holding circuit 12 is inputted to the display data latch circuit 15. Display data is synchronized with the latch pulse ϕdL, and latched by the display data latch circuit 15. Latched data (bit data of seven segments) is supplied to each digit place of the liquid crystal display as a segment signal Seg.

Moreover, according to the present invention, the control section 17 controls the modulo N counter 13 such that the latch pulse ϕdL for latching display data is generated at the time when the switching command of display data is generated.

For example, the control section 17 forcibly ends the count operation of the modulo N counter 13 by a forced reset signal at the time when the switching command of display data is generated. More specifically, the control section 17 supplies a switch command of display data to the modulo N counter 13.

Figure 4:
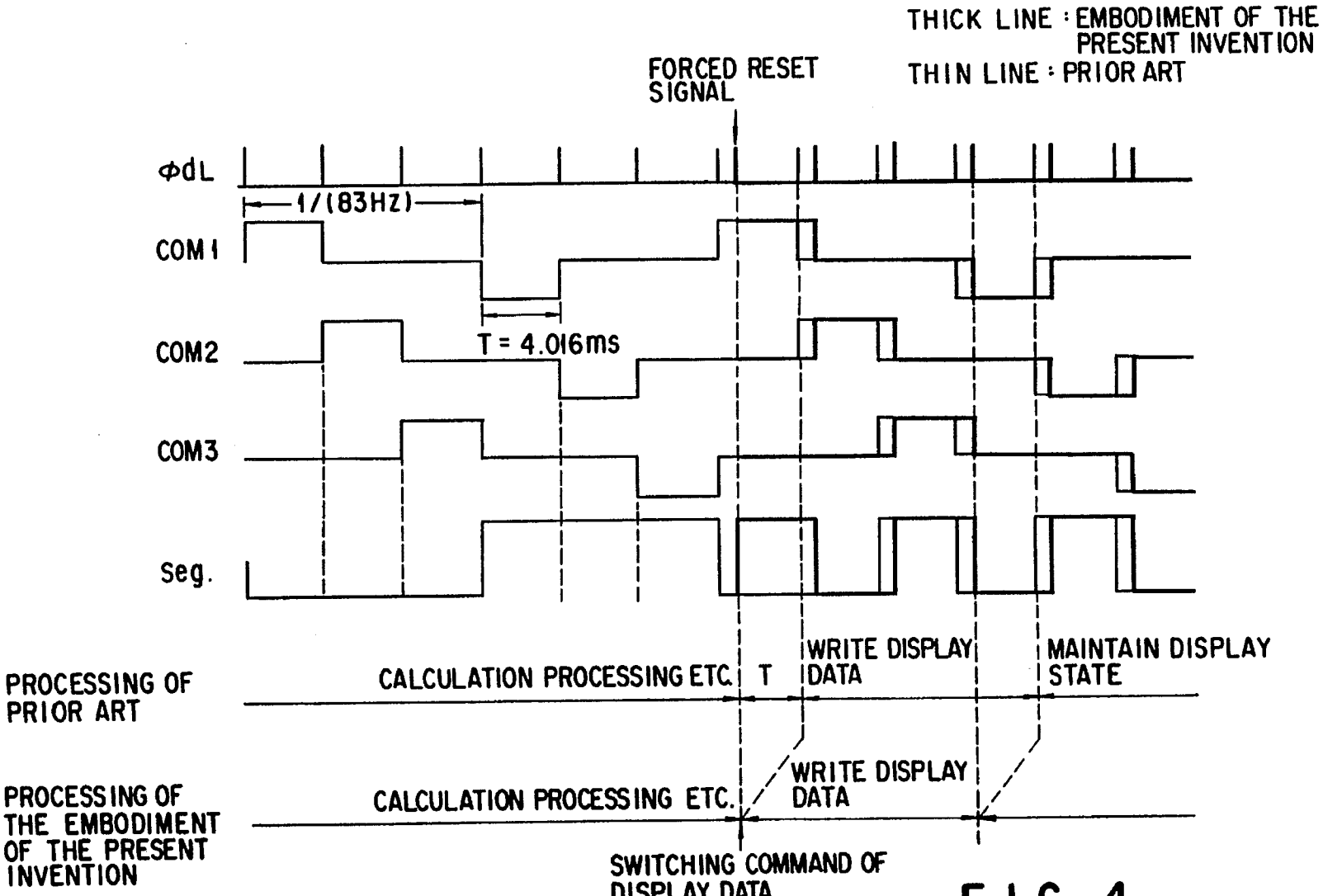
FIG. 4 is a waveform view showing an operation of the device of FIG. 3.

FIG. 4 is a waveform view showing the operation of the character data writing device of FIG. 3 as comparing with the operation of the conventional device.

Figure 1:
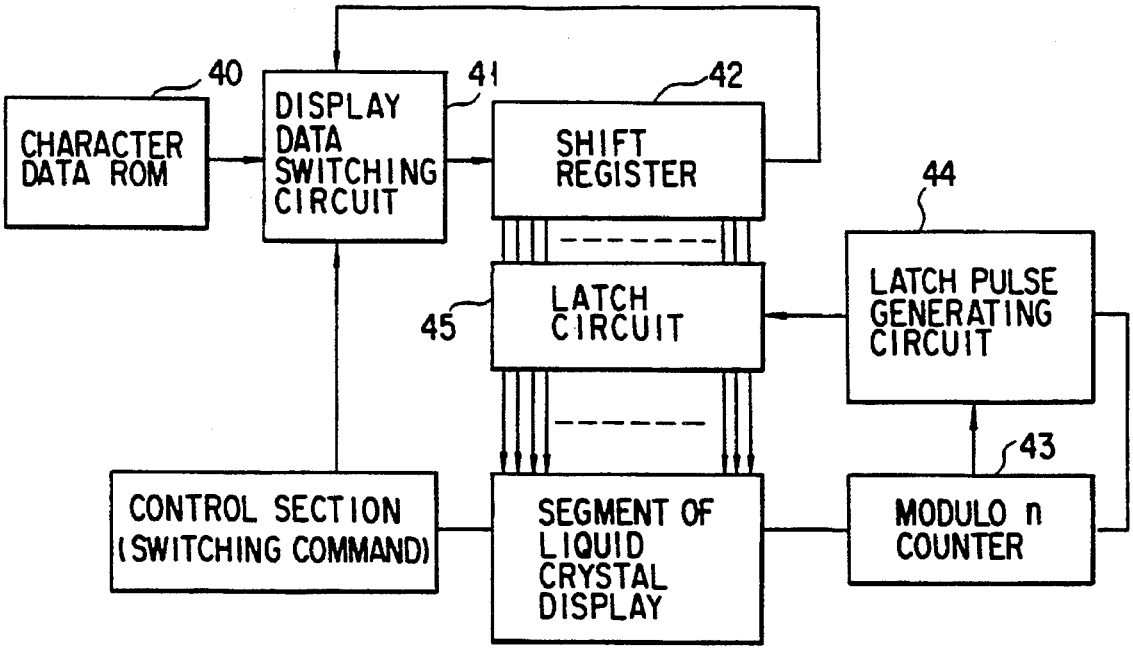
FIG. 1 (PRIOR ART)
FIG. 1 is a block diagram showing a conventional character display data writing device.
Figure 2:
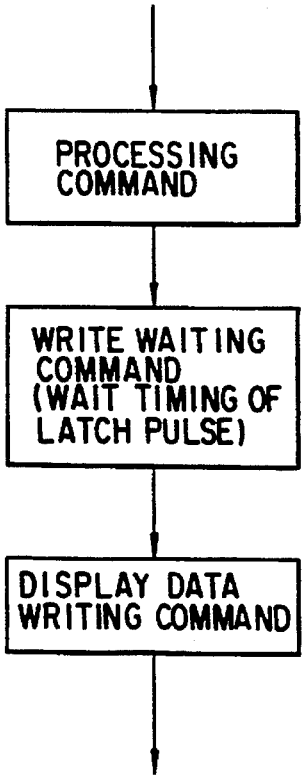
FIG. 2 (PRIOR ART)
FIG. 2 is a flow chart showing a part of a program for controlling an operation of the device of FIG. 1.
Figure 5:
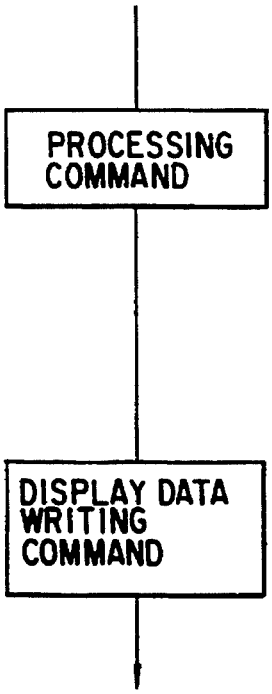
FIG. 5 is a flow chart showing a part of a program for controlling the operation of the device of FIG. 3.

FIG. 5 shows a part of the routine of a program stored in a program memory provided in the liquid crystal calculator including the character writing device of FIG. 3.

The count operation of the modulo N counter 13 is forcibly ended at the time when the switching command of display data is generated, and the modulo N counter 13 generates the reset pulse. The latch pulse generating circuit 14 synchronizes with the reset pulse outputted from the modulo N counter 13, and supplies the latch pulse to the display data latch circuit 15.

Whereby, writing of display data (character data) is immediately performed at the time when the switch command of display data is generated. Therefore, there is no need that the writing of display data is set to be in a standby state by the software processing until the switching command of display data is generated and display data and the latch pulse are synchronized with each other. Also, write waiting time T can be omitted.

As mentioned above, since display data can be written at the time when the switch command of display data is generated, there is no need that the writing of display data is set to be in a standby state. Therefore, the writing speed of display data can be improved without enhancing the clock frequency. In other words, in the case that writing speed of data is the case as the conventional case, the consumption electrical power can be reduced by the reduction of the clock frequency.

Moreover, regarding the routine of the program of FIG. 5, since there is no need that writing standby command is set between the calculation processing command and the display data writing command, thereby making it possible to contribute the reduction of the number of steps of the program.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A character data writing device comprising:

a latch pulse generating section for generating clock pulses and a latch pulse;

a display data holding circuit for holding character data, and serially outputting said character data;

a display data switching circuit for inputting the character data outputted from said display data holding circuit into said display data holding circuit again and for receiving a switching command of display data, thereby switching character data outputted from said display data holding circuit to new character data to be inputted to said display data holding circuit;

a display data latching circuit for latching character data outputted from said display data holding circuit in synchronism with the latch pulse and for supplying the latched character data to a character data display section;

a modulo N counter for counting a number of clock pulses generated by said latch pulse generating section and for generating a reset pulse every time a count of N clock pulses is ended, and said modulo N counter receiving a forced reset signal, and also generating a reset pulse upon receiving said forced reset signal, said latch pulse generating section generating said latch pulse upon each generation of said reset pulse by said modulo N counter; and a control section for supplying the switching command of said display data to said display data switching circuit, and for supplying the forced reset signal to said modulo N counter at the same time, whereby a latch pulse is immediately generated and character data is immediately latched in said display data latching circuit.

2. The character data writing device according to claim 1, wherein said display data holding circuit comprises a plurality of shift registers cascade-connected, character data outputted from said display data switching circuit is inputted to a first shift register, character data outputted from said first shift register is inputted to said display data latch circuit and a last shift register, and character data outputted from said last shift register is inputted to said display data switching circuit.

* * * * *